US010737827B2

(12) United States Patent
Harnack et al.

(10) Patent No.: US 10,737,827 B2
(45) Date of Patent: Aug. 11, 2020

(54) TRACKING DEVICE ENCLOSURE

(71) Applicant: INTERNATIONAL BUSINESS MACHINES CORPORATION, Armonk, NY (US)

(72) Inventors: Tate T. Harnack, Rochester, MN (US); Justin Melby, Rochester, MN (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 0 days.

(21) Appl. No.: 16/183,167

(22) Filed: Nov. 7, 2018

(65) Prior Publication Data

US 2020/0140137 A1 May 7, 2020

(51) Int. Cl.

*B65D 5/50* (2006.01)
*B65D 5/42* (2006.01)
*B65D 5/20* (2006.01)

(52) U.S. Cl.

CPC ..... *B65D 5/5021* (2013.01); *B65D 5/2057* (2013.01); *B65D 5/4204* (2013.01); *B65D 2101/00* (2013.01)

(58) Field of Classification Search

CPC ..... B65D 5/20; B65D 5/2057; B65D 5/42; B65D 5/4204; B65D 5/50; B65D 5/5021; B65D 2101/00; G08B 13/14

USPC ..... 206/320, 459.1, 775

See application file for complete search history.

(56) References Cited

U.S. PATENT DOCUMENTS 5,518,488 A 5/1996 Schluger
6,259,369 B1 * 7/2001 Monico ..... G06K 19/07749 156/291
6,360,944 B1 3/2002 Gorman
6,724,308 B2 * 4/2004 Nicholson ..... B65D 5/4233 340/572.1

(Continued)

FOREIGN PATENT DOCUMENTS

CN 207536319 U * 6/2018

OTHER PUBLICATIONS

Shipping Container Housing, "Shipping Container Tracking," [Accessed Jun. 9, 2018] http://www.shipping-container-housing.com/shipping-container-tracking.html.

(Continued)

*Primary Examiner* — Bryon P Gehman
(74) *Attorney, Agent, or Firm* — Kunzler Bean & Adamson; Bruce R. Needham

(57) ABSTRACT

An apparatus for a tracking device enclosure is disclosed. According to an embodiment of the present invention, the apparatus includes an enclosure that holds a motion tracking device to a shipping container. Further, the enclosure includes one or more first flaps that secure a first motion tracking device within the enclosure such that the first motion tracking device does not move in relation to the enclosure. The one or more first flaps secure the first motion tracking device based on a shape of the first motion tracking device. Also, the enclosure includes one or more second flaps that secure a second motion tracking device within the enclosure such that the second motion tracking device does not move in relation to the enclosure. The one or more second flaps secure the second motion tracking device based on a shape of the second motion tracking device.

19 Claims, 11 Drawing Sheets

(56) References Cited

U.S. PATENT DOCUMENTS

| | | | | |
|---|---|---|---|---|
| 7,710,268 | B2 * | 5/2010 | Schoen | G08B 13/1427 235/375 |
| 7,772,974 | B2 * | 8/2010 | Ehrensvard | B65D 5/4233 340/541 |
| 7,895,131 | B2 | 2/2011 | Kraft | |
| 7,924,157 | B2 * | 4/2011 | Weller | B65D 27/00 340/10.1 |
| 7,969,309 | B2 * | 6/2011 | Abe | B65C 1/042 340/572.1 |
| 8,279,067 | B2 | 10/2012 | Berger et al. | |
| 8,550,550 | B2 | 10/2013 | Cassese et al. | |
| 10,342,737 | B1 * | 7/2019 | Shanmugavelayudam | A61J 1/165 |
| 2004/0070504 | A1 * | 4/2004 | Brollier | B65D 5/42 340/572.8 |
| 2006/0054705 | A1 | 3/2006 | Garton et al. | |
| 2006/0125642 | A1 * | 6/2006 | Chandaria | B65D 5/4212 340/572.8 |
| 2006/0202824 | A1 | 9/2006 | Carroll et al. | |
| 2009/0016308 | A1 | 1/2009 | Twitchell, Jr. | |
| 2010/0012653 | A1 * | 1/2010 | Ulrich | B65D 79/02 220/1.5 |
| 2010/0090832 | A1 * | 4/2010 | Bozet | B65D 5/4237 340/572.8 |
| 2011/0308986 | A1 * | 12/2011 | Lee | B65D 5/0254 206/459.1 |
| 2015/0287299 | A1 * | 10/2015 | Eckert | G08B 13/1418 340/568.2 |

OTHER PUBLICATIONS

C. Ubelacker, "Container at Sea Hazard Detection System." May 26, 2011 [Accessed Jun. 9, 2018] http://www.ubelacker.com/2011/05/container-at-sea-hazard-detection-system/.

Z. Yuan, "A novel RFID-based shipping containers location and identification solution in multimodal transport," 2008 Canadian Conference on Electrical and Computer Engineering, Niagara Falls, ON, 2008, pp. 000267-000272.

Y. Ali, "Stapid: A Secured Approach for Container Monitoring and Tracking," Journal of Traffic and Logistics Engineering vol. 4, No. 2, Dec. 2016, pp. 167-172.

* cited by examiner

TRACKING DEVICE ENCLOSURE

BACKGROUND

The subject matter disclosed herein relates to packaging and more particularly relates to packaging for tracking devices.

In the commerce of today, goods are shipped between different locations. Sometimes, when shipments arrive at the intended destination, the goods may arrive in a damaged condition. When shipments are damaged in transit, the parties to the shipment may desire to identify how and where the shipment was damaged. Accordingly, tracking devices may be used to monitor the movement of the shipment.

SUMMARY

An apparatus for a tracking device enclosure is disclosed. According to an embodiment of the present invention, the apparatus includes an enclosure that holds a motion tracking device to a shipping container. The enclosure includes one or more first flaps that secure a first motion tracking device within the enclosure such that the first motion tracking device does not move in relation to the enclosure. The one or more first flaps secure the first motion tracking device based on a shape of the first motion tracking device. The enclosure includes one or more second flaps that secure a second motion tracking device within the enclosure such that the second motion tracking device does not move in relation to the enclosure. The one or more second flaps secure the second motion tracking device based on a shape of the second motion tracking device.

A further apparatus for a tracking device enclosure is disclosed. According to an additional embodiment of the present invention, the apparatus includes an enclosure that holds a motion tracking device to a shipping container. The enclosure includes a plurality of flaps that secure the motion tracking device within the enclosure such that the motion tracking device does not move in relation to the enclosure. The plurality of flaps secures the motion tracking device based on a shape of the motion tracking device. The plurality of flaps includes a first flap with tabs, the first flap folds over the motion tracking device and the tabs of the first flap fold into openings in the enclosure. The plurality of flaps includes a second flap that folds back over the first flap. When the second flap is secured over the first flap, the second flap encloses the motion tracking device within the enclosure based on the shape of the motion tracking device. The apparatus includes one or more attaching tabs extending from a bottom of the enclosure. The one or more attaching tabs extend away from the enclosure. The one or more attaching tabs are attachable to a surface of the shipping container to secure the enclosure to the shipping container.

An additional apparatus for a tracking device enclosure is disclosed. According to a further embodiment of the present invention, the apparatus includes an enclosure that holds a motion tracking device. The enclosure includes a plurality of first flaps that secure a first motion tracking device within the enclosure such that the first motion tracking device does not move in relation to the enclosure. The plurality of first flaps secure the first motion tracking device based on a shape of the first motion tracking device. The plurality of first flaps comprise a third flap with tabs. The third flap folds over the first motion tracking device and the tabs of the third flap fold into openings in the enclosure. The enclosure also includes a plurality of second flaps that secures a second motion tracking device within the enclosure such that the second motion tracking device does not move in relation to the enclosure. The plurality of second flaps secures the second motion tracking device based on a shape of the second motion tracking device. The plurality of second flaps comprises a fourth flap. The fourth flap folds back over the third flap. The fourth flap encloses the second motion tracking device. The apparatus includes one or more attaching tabs extending from a bottom of the enclosure. The one or more attaching tabs extend away from the enclosure. The one or more attaching tabs are attachable to a surface of the shipping container to secure the enclosure to the shipping container.

BRIEF DESCRIPTION OF THE DRAWINGS

In order that the advantages of the embodiments of the invention will be readily understood, a more particular description of the embodiments briefly described above will be rendered by reference to specific embodiments that are illustrated in the appended drawings. Understanding that these drawings depict only some embodiments and are not therefore to be considered to be limiting of scope, the embodiments will be described and explained with additional specificity and detail through the use of the accompanying drawings, in which.

DETAILED DESCRIPTION OF THE INVENTION

Figure 1A:
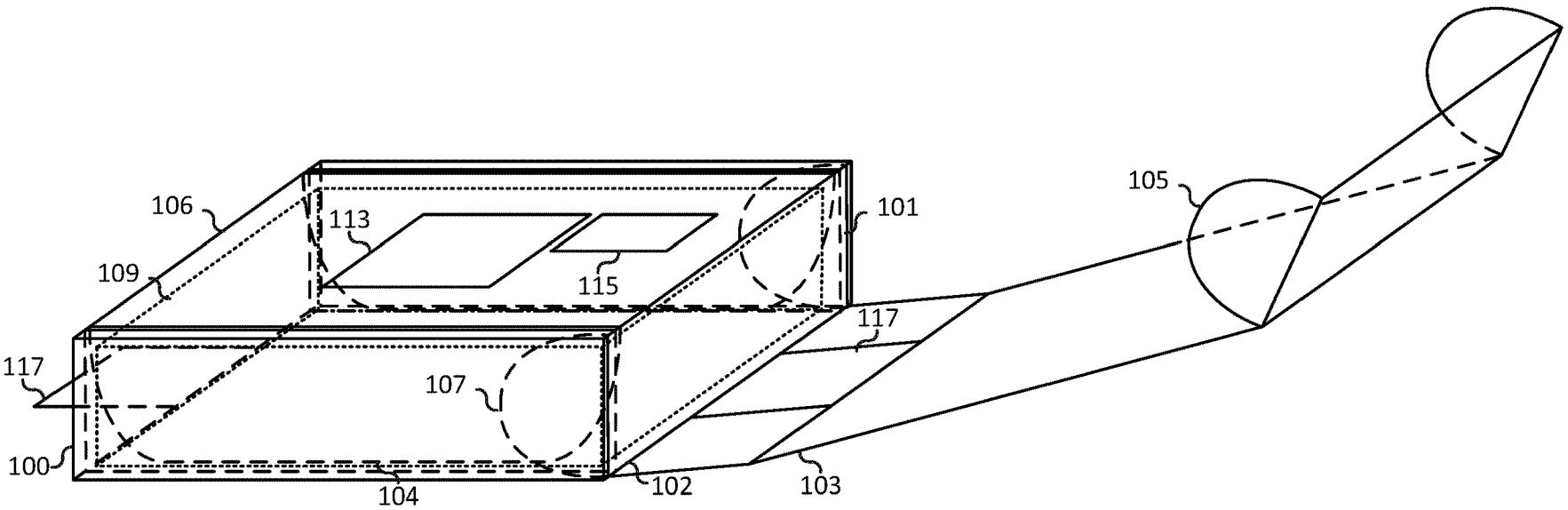
FIG. 1A is a perspective diagram illustrating one embodiment of a tracking device enclosure for securing a first motion tracking device.

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Furthermore, the described features, advantages, and characteristics of the embodiments may be combined in any suitable manner. One skilled in the relevant art will recognize that the embodiments may be practiced without one or more of the specific features or advantages of a particular embodiment. In other instances, additional features and advantages may be recognized in certain embodiments that may not be present in all embodiments.

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

An apparatus for a tracking device enclosure is disclosed. One embodiment of an apparatus includes an enclosure that holds a motion tracking device to a shipping container. The enclosure includes one or more first flaps that secure a first motion tracking device within the enclosure such that the first motion tracking device does not move in relation to the enclosure. The one or more first flaps secure the first motion tracking device based on a shape of the first motion tracking device. The enclosure includes one or more second flaps that secure a second motion tracking device within the enclosure such that the second motion tracking device does not move in relation to the enclosure. The one or more second flaps secure the second motion tracking device based on a shape of the second motion tracking device.

In some embodiments, an apparatus further includes one or more attaching tabs extending from a bottom of the enclosure. The one or more attaching tabs extend away from the enclosure. The one or more attaching tabs are attachable to a surface of the shipping container to secure the enclosure to the shipping container. The one or more attaching tabs are perforated to remain connected to the shipping container when the enclosure is pulled away from the shipping container.

In certain embodiments, the one or more first flaps include a first flap that folds over the motion tracking device and one or more tabs that fold into openings in the enclosure. The one or more second flaps include a second flap that folds back over the first flap. When the second flap is secured over the first flap, the second flap encloses the motion tracking device within the enclosure based on the shape of the motion tracking device.

In certain embodiments, the enclosure further includes one or more access flaps that provide access to activation features of the motion tracking device. The enclosure further includes one or more activation slots to remove an activation tab of the second motion tracking device. A portion of the one or more second flaps extends into a space for holding the first motion tracking device. The second motion tracking device is secured within the space. The enclosure is made from a single sheet of pliable material.

In certain embodiments, the enclosure includes one or more holes that secure one or more tabs in place. The one or more tabs are located at ends of a portion of the one or more first flaps and a portion of the one or more second flaps. The enclosure is secured in a closed state with one or more tamper resistant seals. The enclosure includes one or more openings for viewing or adding markings on the motion tracking devices. The second motion tracking device is smaller than the first motion tracking device. The enclosure includes one or more openings to expose the motion tracking device to an environment of the enclosure. Additionally, the motion tracking device senses characteristics of an environment of the container.

One embodiment of an apparatus includes an enclosure that holds a motion tracking device to a shipping container, the enclosure including a plurality of flaps that secure the motion tracking device within the enclosure such that the motion tracking device does not move in relation to the enclosure. The plurality of flaps secures the motion tracking device based on a shape of the motion tracking device. The plurality of flaps includes a first flap with tabs, the first flap folds over the motion tracking device and the tabs of the first flap fold into openings in the enclosure. The plurality of flaps includes a second flap that folds back over the first flap. When the second flap is secured over the first flap, the second flap encloses the motion tracking device within the enclosure based on the shape of the motion tracking device. The enclosure includes one or more attaching tabs extending from a bottom of the enclosure. The one or more attaching tabs extend away from the enclosure. The one or more attaching tabs are attachable to a surface of the shipping container to secure the enclosure to the shipping container.

In certain embodiments, the plurality of flaps further includes one or more third flaps that secure a first motion tracking device within the enclosure such that the first motion tracking device does not move in relation to the enclosure. The one or more third flaps secure the first motion tracking device. The plurality of flaps includes one or more fourth flaps that secure a second motion tracking device within the enclosure such that the second motion tracking device does not move in relation to the enclosure. The one or more attaching tabs are perforated to remain connected to the shipping container when the enclosure is pulled away from the shipping container. The enclosure further includes one or more access flaps that provide access to activation features of the motion tracking device. The enclosure is made from a single sheet of pliable material. The enclosure includes one or more openings for viewing or adding markings on the motion tracking devices.

One embodiment of an apparatus includes an enclosure that holds a motion tracking device. The enclosure includes a plurality of first flaps that secure a first motion tracking device within the enclosure such that the first motion tracking device does not move in relation to the enclosure. The plurality of first flaps secures the first motion tracking device based on a shape of the first motion tracking device. The plurality of first flaps include a third flap with tabs. The third flap folds over the first motion tracking device and the tabs of the third flap fold into openings in the enclosure. The enclosure includes a plurality of second flaps that secure a second motion tracking device within the enclosure such that the second motion tracking device does not move in relation to the enclosure. The plurality of second flaps secure the second motion tracking device based on a shape of the second motion tracking device. The plurality of second flaps includes a fourth flap. The fourth flap folds back over the third flap, where the fourth flap encloses the second motion tracking device. The enclosure includes one or more attaching tabs extending from a bottom of the enclosure. The one or more attaching tabs extend away from the enclosure and the one or more attaching tabs are attachable to a surface of the shipping container to secure the enclosure to the shipping container.

The description of elements in each figure may refer to elements of proceeding figures. Like numbers refer to like elements in all figures, including alternate embodiments of like elements.

FIG. 1A is a perspective diagram illustrating one embodiment of a enclosure 100 for securing a first motion tracking device 109. The enclosure 100 may be used for securing motion tracking devices to a shipping container. In particular, shipping containers may be shipped between different locations. Sometimes, when the shipping container arrives at the shipping destination, the goods contained within the shipping container may be damaged. In particular, fragile goods, such as computing equipment, may be susceptible to damage that may result from shocks, drops, and other movement types that can occur during shipping. When goods are damaged, it may be difficult to determine when, where, and how the damage occurred.

In certain embodiments, a motion tracking device may be shipped with a shipping container to track the movements experienced by the shipping container. When shipped goods are damaged, the tracked motion data may aid in identifying when the goods became damaged. In certain embodiments, the motion tracking device may include one or more motion sensors such as a global positioning device, an inertial measurement unit, and the like. Further, the motion tracking device may include a storage device to store motion data during the shipment. Also, a user may be able to connect the motion tracking device to another computing device to acquire the motion data from the motion tracking device. Further, the shipping container may be a pallet, a box, a metal container, and the like.

In certain embodiments, to accurately measure the motion of the shipping container, the motion tracking device may be mounted to the shipping container in such a way that the motion experienced by the motion tracking device is the same as the motion experienced by the shipping container. To ensure that the shipping container and the motion tracking device experience the same motion, a motion tracking device may be located within an enclosure 100, where the enclosure 100 holds the motion tracking device to a shipping container using attaching tabs 117 or other means for attaching the enclosure 100 to the shipping container. Further, the enclosure 100 may securely hold the motion tracking device within the enclosure 100, such that the motion tracking device is sufficiently limited with respect to the enclosure 100.

In some embodiments, the enclosure 100 may be configurable to secure multiple motion tracking devices within the enclosure 100 based on the particular shape of the motion tracking device. For example, the enclosure 100 may secure a first motion tracking device 109 within the enclosure 100. To secure the first motion tracking device 109 within the enclosure 100, the enclosure 100 may be sized such that the interior volume of the enclosure 100 is substantially similar to the dimensions of the first motion tracking device 109. In some embodiments, the enclosure 100 may be a box having a first flap 101 for enclosing the first motion tracking device 109 within the enclosure 100. For example, the first motion tracking device 109 may be placed within the enclosure 100, which may be a box. The first flap 101 may then be closed over the first motion tracking device 109 and tabs 107, attached to the first flap 101, may be inserted into edges of the enclosure 100 to enclose the first motion tracking device 109 within the enclosure 100. Additionally, flaps 104 attached to the first flap 101 may be inserted into the enclosure to apply pressure against opposite sides of the first motion tracking device 109. When the tabs 107 are inserted into the edges of the enclosure 100, the first motion tracking device 109 may be securely located within the enclosure 100.

In certain embodiments, the first flap 101 may have securing flaps 113 and 115 formed therein. For example, the securing flaps 113 and 115 may have multiple edges cut out of the first flap 101 where one edge of the securing flaps 113 and 115 is attached to the first flap 101. As one edge of the securing flaps 113 and 115 is attached to the first flap 101, the securing flaps 113 and 115 may be rotationally moveable about an axis formed through the edge of the securing flaps 113 and 115 that is attached to the first flap 101.

In additional embodiments, the enclosure 100 may include a second flap 103 attached to the first flap 101. For example, the first flap 101 may have a first edge 106 attached to a body for the enclosure 100, where the first flap 101 is rotatable about the first edge 106. Further, the second flap 103 may be attached to a second edge 102 of the first flap 101, where the second edge 102 of the first flap 101 is at an opposite end of the first flap 101 from the first edge 106 attached to the body of the enclosure 100. Also, the second flap 103 may be rotatable about the second edge 102 such that the second flap 103 may be rotatable back over the first flap 101. Additionally, the second flap 103 includes tabs 105 for insertion into an edge of the enclosure 100. For example, the tabs 105 may be inserted into a side of the enclosure 100 that is opposite to the side of the enclosure 100 where the tabs 107 of the first flap 101 are inserted into the enclosure 100. The second flap 103 may further secure the first motion tracking device 109 within the enclosure 100.

Figure 1B:
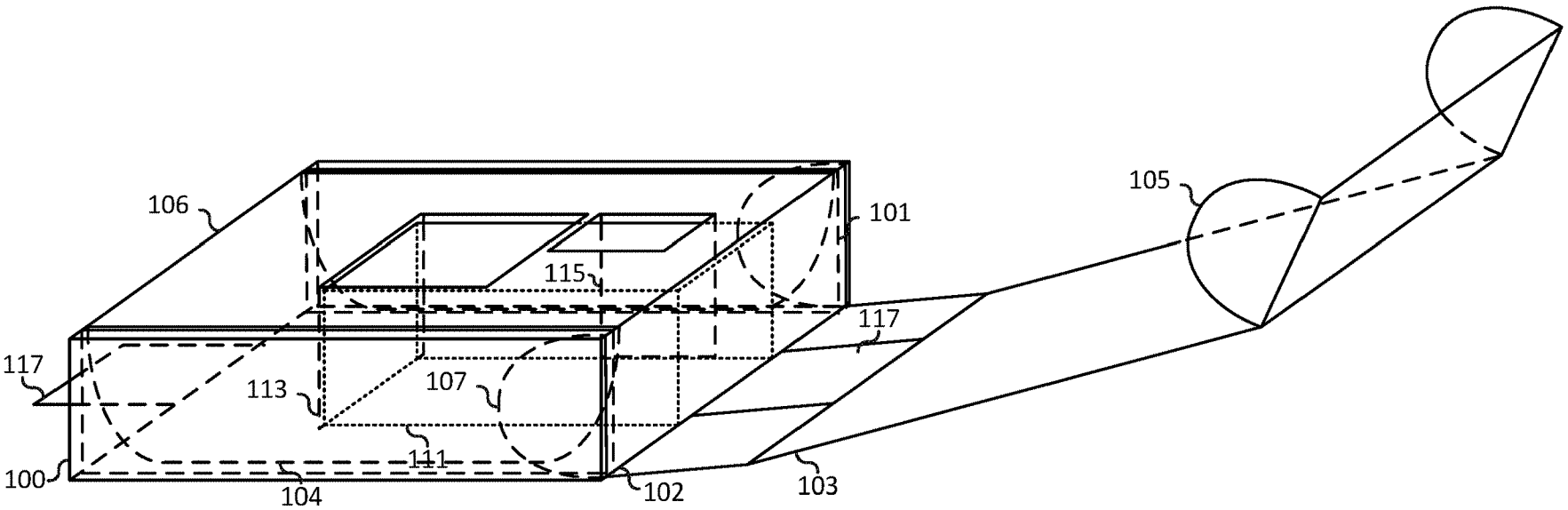
FIG. 1B is a perspective diagram illustrating one embodiment of a tracking device enclosure for securing a second motion tracking device.

FIG. 1B is a perspective diagram illustrating one embodiment of an enclosure 100 for securing a second motion tracking device 111. For example, as described above with respect to FIG. 1A, the enclosure 100 may enclose a first motion tracking device 109. Also, the enclosure 100 may be configurable to securely hold a second motion tracking device 111. As used herein, the second motion tracking device 111 may be another type of motion tracking device that has a different size and shape from the first motion tracking device 109. For example, the second motion tracking device 111 may be smaller, such that the second motion tracking device 111 fills a portion of the interior of the enclosure 100.

In certain embodiments, as the second motion tracking device 111 fills a portion of the interior of the enclosure 100, the first flap 101 may include one or more flaps that may fold down into the volume of the enclosure 100 to secure the position of the second motion tracking device 111 in relation to the enclosure 100. For example, the flaps 113 and 115 described above in FIG. 1 may be foldable into the volume of the enclosure 100. When the flaps 113 and 115 are extended into the enclosure 100, the flaps 113 and 115 may be folded into secured positions within the enclosure 100. The secured flaps 113 and 115 may apply pressure against adjacent or opposite sides of the second motion tracking device 111 and one or more interior sides of the enclosure 100 may apply pressure against one or more other sides of the second motion tracking device 111. The applied pressure against the sides of the second motion tracking device 111 secures the position of the second motion tracking device 111 in relation to the enclosure 100, such that the second motion tracking device 111 does not move within the enclosure 100 when the enclosure 100 is moved.

In certain embodiments, the first flap 101, flaps 104, and tabs 107 may be secured to the enclosure 100, as described above with respect to FIG. 1, before the secured flaps 113 and 115 are secured within the enclosure 100. When the first flap 101 and tabs 107 are secured, the flaps 113 and 115 may be pushed down into the enclosure 100 and secured within the enclosure 100. When the flaps 113 and 115 are secured within the enclosure, the second motion tracking device 111 may be inserted through the first flap 101 into the volume of the enclosure 100. Additionally, when the second motion tracking device 111 is inserted into the enclosure 100, the second flap 103 may be folded over the first flap 101 at the second edge 102, where the tabs 105 are inserted into the enclosure 100 as described above in FIG. 1. By securing the tabs 105 into the enclosure 100, the second flap 103 may secure the second motion tracking device 111 within the enclosure 100. Further, folding the second flap 103 over the first flap 101 may secure the first flap 101 within the enclosure. Accordingly, the flaps of the enclosure 100 may be configurable to secure multiple types of motion tracking devices within the enclosure 100.

Figure 2:
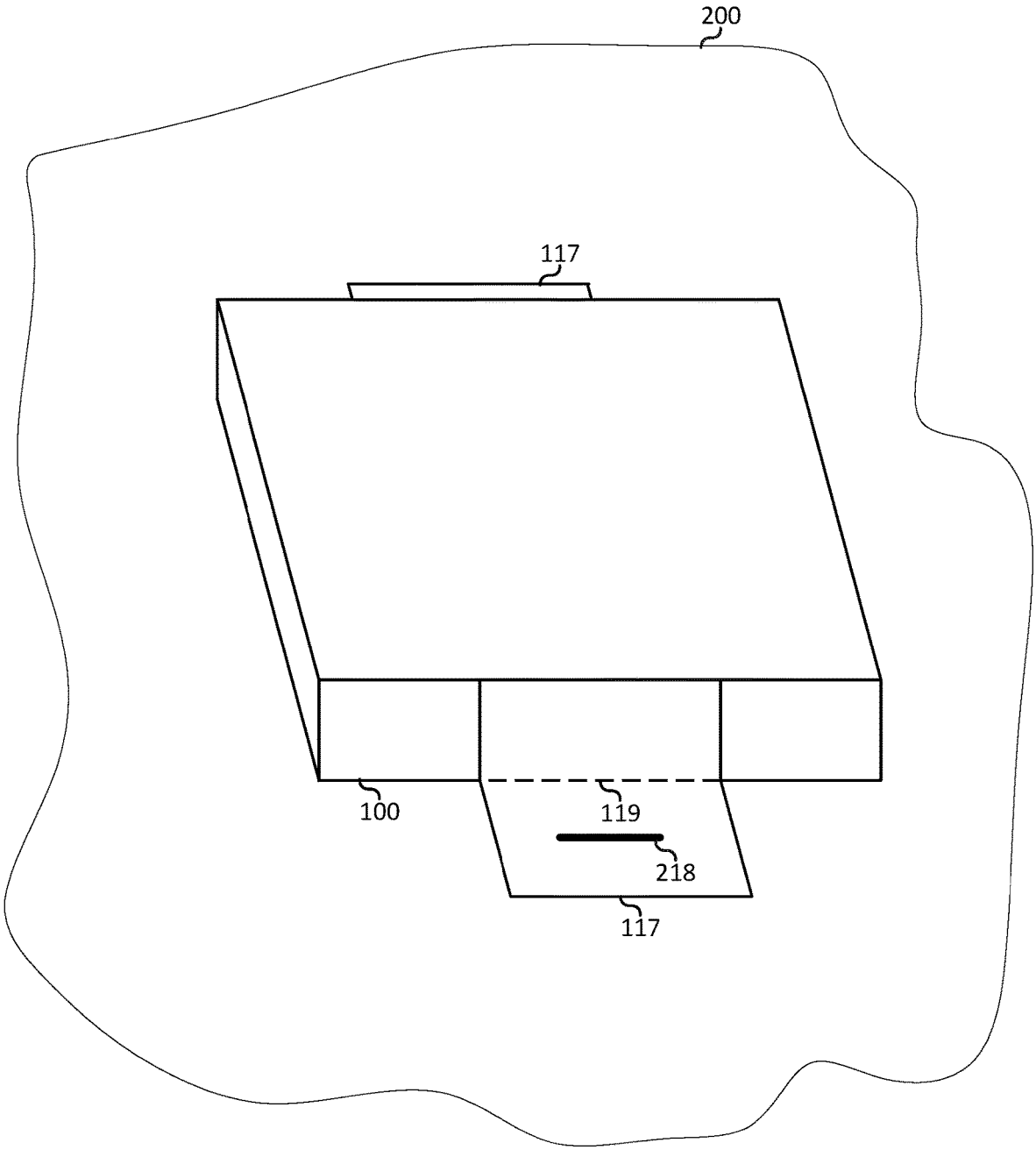
FIG. 2 is a perspective diagram illustrating one embodiment of attaching tabs for securing a tracking device enclosure to a shipping container.

FIG. 2 is a perspective diagram illustrating one embodiment of attaching tabs 117 for securing an enclosure 100 to a shipping container 200. For example, when a motion tracking device is secured within the enclosure 100, the enclosure 100 may be secured to a shipping container 200. As used herein, a shipping container 200 may generally refer to a pallet, a box, a crate, a bin, and other similar containers that may be used for shipping goods. In certain implementations, the enclosure 100 may be secured to the shipping container 200 with an attachment type 218. As used herein, an attachment type 218 refers to a manner of securing the enclosure 100 to the shipping container 200. For example, an attachment type may be staples, tape, glue, or other method of attaching the enclosure 100 to the shipping container 200. In some embodiments, the attachment type 218 may attach the bottom or other portion of the enclosure 100 to the shipping container 200. For example, the enclosure may be taped to the shipping container 200. Also, the bottom of the enclosure 100 may be stapled, glued, or secured with some other means to the shipping container 200. Further, the attachment type 218 may secure the enclosure 100 at a location of the enclosure that easily tears away from the enclosure 100 such that the enclosure 100 may be easily removed from the shipping container 200 while still enclosing a motion tracking device. The enclosure 100 and enclosed motion tracking device may then be sent to a desired destination.

In certain embodiments, the enclosure 100 may include one or more attaching tabs 117 attached to the enclosure 100. For example, the attaching tabs 117 may be connected to and extending from a bottom of the enclosure 100. As described herein, the bottom of the enclosure 100 may refer to a surface of the enclosure 100 opposite to the surface covered by the first flap 101 and the second flap 103 and which faces the shipping container 200 to which the enclosure 100 may be attached. In some embodiments, the attaching tabs 117 may extend from opposite edges of the bottom of the enclosure 100. Alternatively, the attaching tabs 117 may extend from adjacent edges, all edges, a single edge, or other combination of edges of the bottom of the enclosure 100. Further, attaching tabs 117 may extend from other parts of the enclosure 100.

To attach the enclosure 100 to a shipping container 200, the attaching tabs 117 may be fixedly attached to a shipping container 200 with an attachment type 218. For example, the attaching tabs 117 may be placed against a surface (either interior or exterior) of a shipping container 200, where the attaching tabs 117 may be stapled to the shipping container 200. Further, the attaching tabs 117 may be glued, taped, or secured with another manner of attachment type 218 for fixedly securing the attaching tabs 117 to the shipping container 200. By fixedly securing the attaching tabs 117 to the shipping container 200, the movements experienced by the enclosure 100 is likely to mimic the movements experienced by the shipping container 200.

In a further embodiment, the attaching tabs 117 may be connected to the enclosure 100 at a perforation 119 such that after the one or more attaching tabs 117 are fixedly attached to a shipping container 200, when the enclosure 100 is pulled away from the shipping container 200, the attaching tabs 117 may tear away from the enclosure 100 at the perforation 119 and remain connected to the shipping container 200. As the enclosure 100 is now free from the shipping container 200, the enclosure 100 and enclosed motion tracking device may be shipped back to the shipper or taken to some other destination for analysis of the movement experienced by the shipping container 200.

Figure 3:
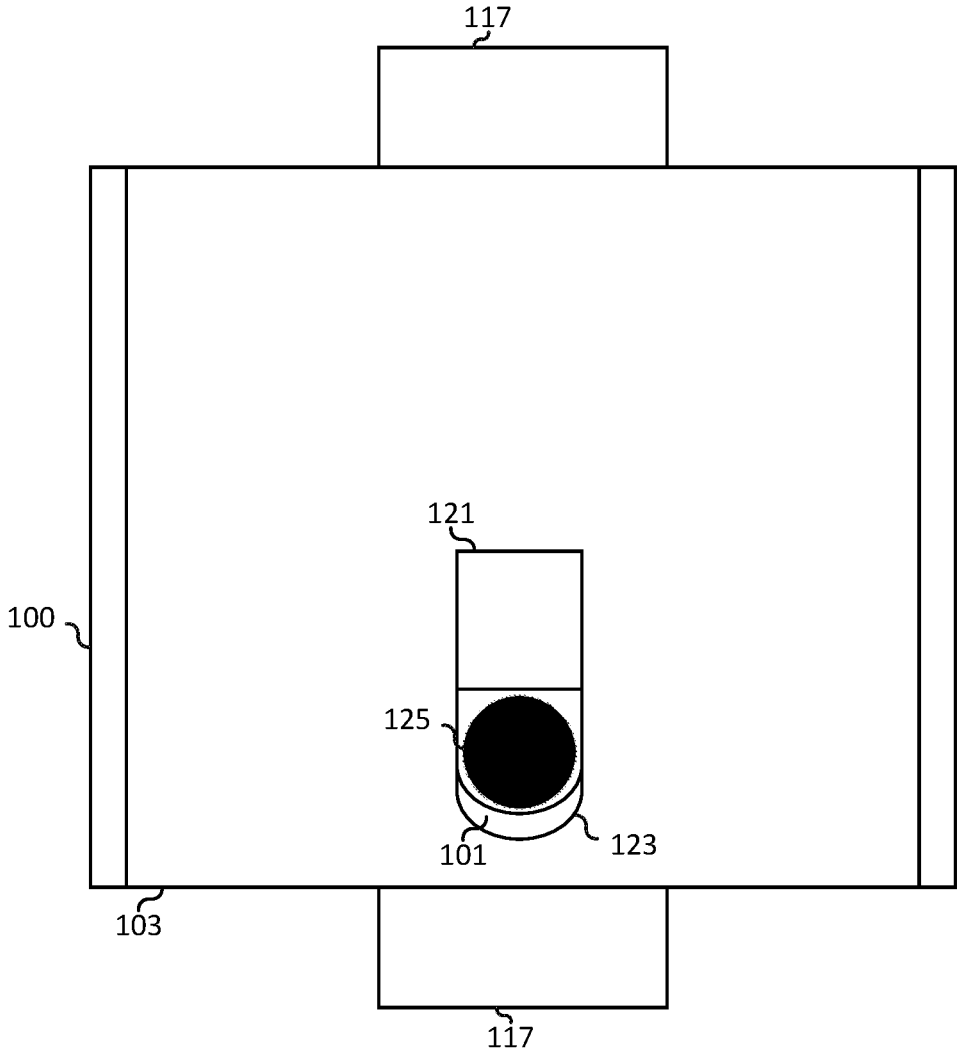
FIG. 3 is a diagram illustrating one embodiment of an access flap for activating a motion tracking device within a tracking device enclosure.

FIG. 3 is a diagram illustrating one embodiment of an access flap 121 for activating a first motion tracking device 109 within an enclosure 100. For example, the first motion tracking device 109 may be in an inactive state when it is initially placed in the enclosure 100. It may be desirable to wait until the enclosure 100 is attached to the shipping container before activating the first motion tracking device 109, such that the data recorded by the first motion tracking device 109 is associated with the movement of the shipping container attached to the enclosure 100.

In certain embodiments, to facilitate the activation of the first motion tracking device 109, the second flap 103 may include an access flap 121 formed therein. Where the access flap 121 provides access to an activation feature 125 on the first motion tracking device 109. For example, the access flap 121 may be a flap in the second flap 103 that lifts up at an access location 123. The access location 123 may be located at a place on the second flap 103 and the first flap 101, such that the activation feature 125 may be accessed in such a way that a user may activate the first motion tracking device 109. For example, the activation feature 125 may be a button, a switch, and the like.

In some embodiments, when the activation feature 125 is a button, the enclosure 100 may be attached to a shipping container. A user may then lift up the access flap 121 to access the activation feature 125 which is accessible through overlapping holes formed at an access location 123 in the first flap 101 and the second flap 103. The user may then press the activation feature 125 to cause the first motion tracking device 109 to begin tracking the movement of the first motion tracking device 109, the enclosure 100, and the shipping container to which the enclosure 100 is attached.

In certain embodiments, the access location 123 may include a hole through the first flap 101. Further, the access flap 121, when closed, may cover the access location 123 on the first flap 101. Also, the access flap 121 may rest against a portion of the first flap 101 to prevent the access flap 121 from being pushed into the hole through the first flap at the access location 123. As a hole through the first flap 101 at the access location 123 is between the access flap 121 and the activation feature 125, a gap may exist between the access flap 121 and the activation feature 125. In some embodiments, the gap between the access flap 121 and the activation feature 125 may prevent accidental shocks or pressure applied to the enclosure from accidentally activating the first motion tracking device 109.

In an alternative, embodiment, the activation feature 125 may be located on a second motion tracking device 111 such that the second motion tracking device 111 is activated when a user pushes the activation feature 125. Alternatively, other motion tracking devices secured within the enclosure 100 may be activated by an activation feature 125 that is accessible by lifting the access flap 121.

Figure 4:
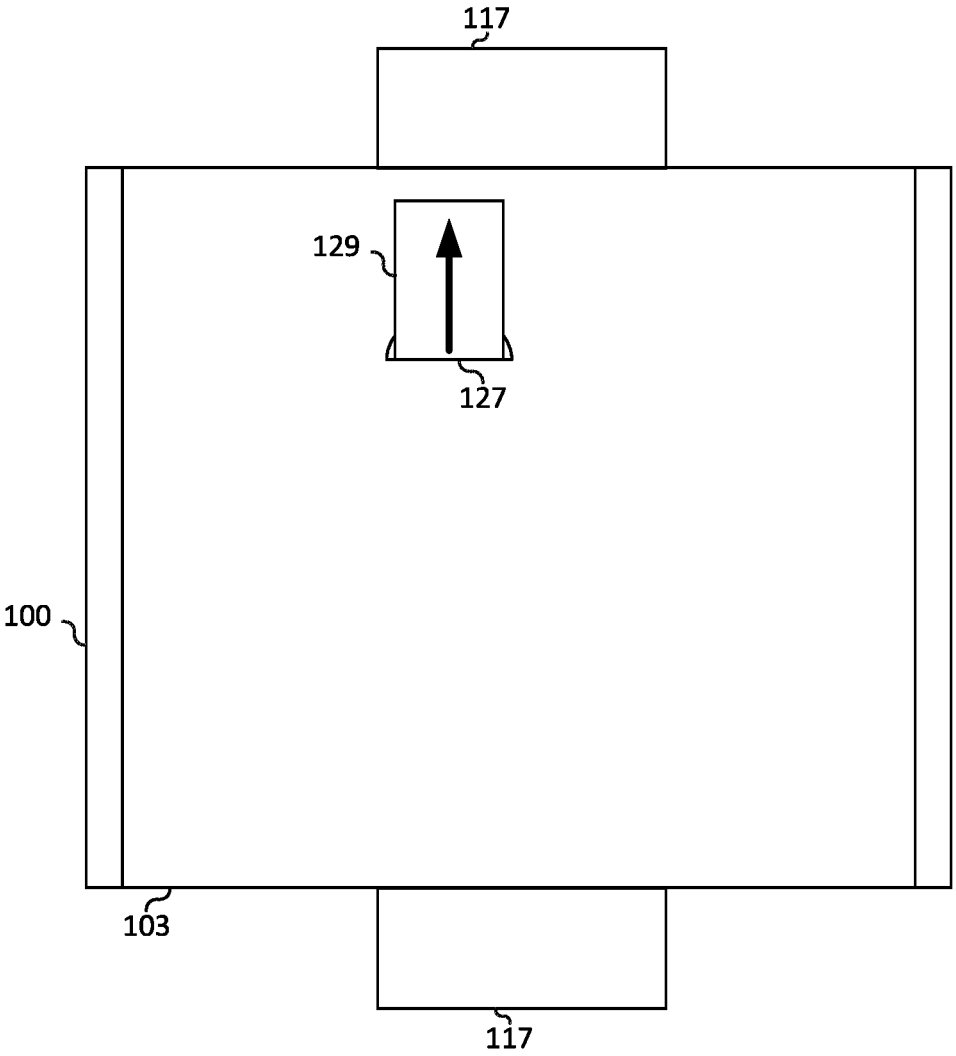
FIG. 4 is a diagram illustrating a further embodiment of an access slot for activating a motion tracking device within a tracking device enclosure.

FIG. 4 is a diagram illustrating a further embodiment of an activation slot 127 for activating a second motion tracking device 111 within an enclosure 100. For example, the second motion tracking device 111 may be in an inactive state when it is initially placed in the enclosure 100. Like the first motion tracking device 109, described above with relation to FIG. 3, it may be desirable to wait until the enclosure 100 is attached to the shipping container before activating the second motion tracking device 111, such that the data recorded by the second motion tracking device 111 is associated with the movement of the shipping container attached to the enclosure 100.

In certain embodiments, to facilitate the activation of the second motion tracking device 111, the second flap 103 may include an activation slot 127 formed therein. Also, the first flap 101 may also include an access slot. An activation tab 129 may extend through the activation slot 127 and the access slot formed in the first flap 101. While the activation tab 129 is within the second motion tracking device 111, the second motion tracking device 111 may be inactive. When the activation tab 129 is removed, the second motion tracking device 111 becomes activated.

In an alternative, embodiment, the activation tab 129 may be located on a first motion tracking device 109 such that the first motion tracking device 109 is activated when a user removes the activation tab 129. Alternatively, other motion tracking devices secured within the enclosure 100 may be activated by pulling an activation tab 129 connected to the motion tracking device through the activation slot 127.

Figure 5:
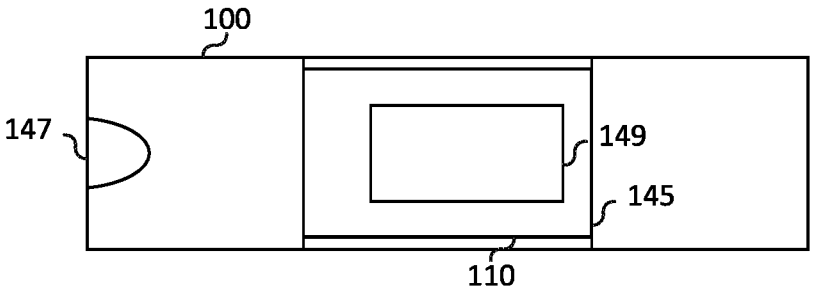
FIG. 5 is a diagram illustrating one embodiment of an opening for viewing or adding markings on motion tracking devices within a tracking device enclosure.

FIG. 5 is a diagram illustrating one embodiment of an opening 145 for viewing or adding markings on motion tracking devices 110 within an enclosure 100. For example, an opening 145 may be formed on a side of the enclosure 100. In some embodiments, the attaching tabs 117 may be formed by folding a portion of a side of the enclosure 100 away from the enclosure 100. When the attaching tabs 117 are folded away from the enclosure 100, an opening 145 may be formed on the side of the enclosure 100. Alternatively, the opening 145 may be formed at other locations on the enclosure 100.

In certain embodiments, a motion tracking device 110 may be placed within the enclosure 100. As used herein, the motion tracking device 110 may be the first motion tracking device 109, the second motion tracking device 111, or other motion tracking device. When the motion tracking device 110 is placed within the enclosure 100, the motion tracking device 110 may be placed in such a way that a marking region 149 may be visible and accessible through the opening 145. A marking region 149 may be a region on the motion tracking device 110 that contains markings to be read by an individual. Also, an individual may apply markings to the marking region 149 through the opening 145. Accordingly, the markings may be used to track the shipping of the enclosure 100 when it is attached to a shipping container that is shipped between different locations.

In further embodiments, when the motion tracking device 110 is placed within the enclosure 100, a tamper resistant seal 147 may be placed at a location on the enclosure 100 such that opening the enclosure 100 breaks the tamper resistant seal 147. Accordingly, when the enclosure 100 is prepared for shipping, the tamper resistant seal 147 may be placed on the enclosure 100. The enclosure 100 may then be shipped to a destination and the enclosure 100 may be removed from the shipping container. When the enclosure 100 is returned to an authorized individual, the individual may be able to determine if someone tampered with the motion tracking device based on the state of the tamper resistant seal 147.

In certain embodiments, the enclosure 100 may completely enclose the motion tracking device 110 save the portion of the motion tracking device 110 having the marking region 149. Accordingly, the motion tracking device 110 is inaccessible to tampering without breaking the tamper resistant seal 147. For example, when the securing tabs 105 of the second flap 103 are in place, the second flap 103 covers access to the motion tracking device 110 to prevent tampering with the motion tracking device 110 unless the enclosure 100 is damaged. In some embodiments, the securing tabs 107 and the second flap 103 may be shaped in such a way that the securing tabs 107 cannot be removed from the enclosure 100 without damaging either the enclosure 100 and/or the tamper resistant seal 147. As such, the second flap 103 may prevent access to the motion tracking device 110 within the enclosure 100 and securely enclose the motion tracking device 110 with respect to the enclosure 100. Alternatively, multiple tamper resistant seals 147 may be placed over the opposite ends of the enclosure to secure the first flap 101 and the second flap 103 in place.

Figure 6:
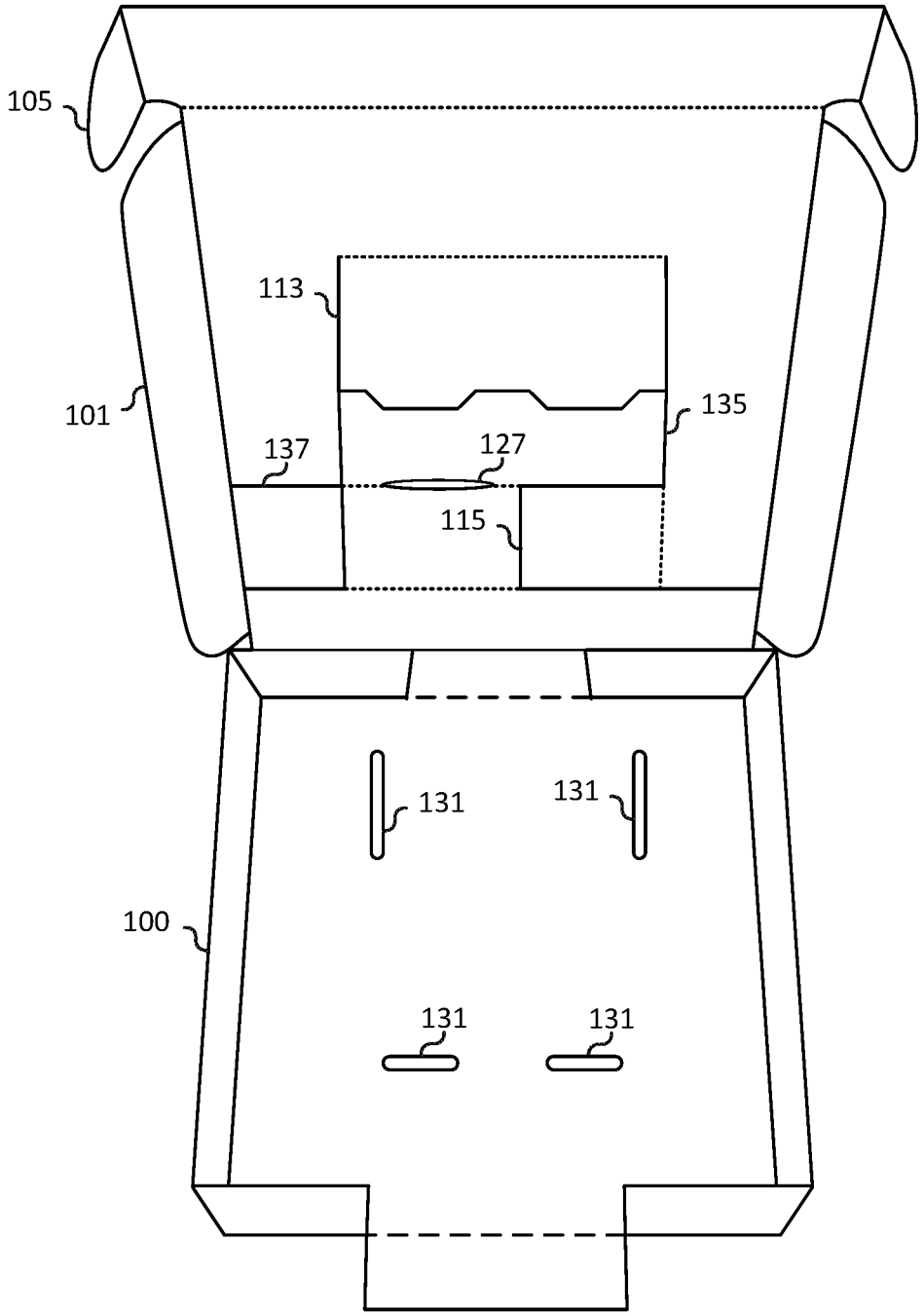
FIG. 6 is a diagram illustrating one embodiment of the interior of a tracking device enclosure.

FIG. 6 is a diagram illustrating one embodiment of the interior of an enclosure 100. For example, the enclosure 100 may be substantially large enough to enclose one or more motion tracking devices. As shown, the enclosure 100 may include multiple holes 131 that may facilitate configuring different flaps to securely hold multiple types of motion tracking devices within the enclosure 100.

For example, to secure the first motion tracking device 109 within the enclosure 100, the first motion tracking device 109 may be inserted within the enclosure 100, whereupon the first flap 101 may be closed over the first motion tracking device 109. When the first flap 101 is folded over the first motion tracking device 109, the tabs 105 on the first flap 101 may be inserted into sides of the enclosure 100 to secure the first flap 101 over the first motion tracking device 109.

Further, to secure the second motion tracking device 111 within the enclosure 100, the second motion tracking device 111 may be inserted into the enclosure 100 after the first flap 101 is folded to enclose the interior of the enclosure 100. To securely position the second motion tracking device 111 within the enclosure 100, securing flaps may be formed within the first flap 101. For example, securing flaps 113 and 115 may be formed in the first flap 101. When the first flap 101 is folded to enclose the interior of the enclosure 100, the securing flaps 113 and 115 may be pushed down into the interior of the enclosure 100. In some embodiments, the securing flaps 113 and 115 may include tabs formed on the ends of the securing flaps 113 and 115 that are inserted into holes 131 formed on the bottom of the enclosure 100. When the securing flaps 113 and 115 are held in place by the holes 131, the securing flaps 113 and 115 may provide surfaces that secure the second motion tracking device 111 within the enclosure 100. Additionally, the tabs 137 and 135 may be lifted for inserting the second motion tracking device 111 within the enclosure 100. When the second motion tracking device 111 is placed within the enclosure 100, the tab 137 may be folded down into the enclosure 100 and into a corresponding hole 131 to further secure the second motion tracking device 111. Further, activation features on the second motion tracking device 111, such as an activation tab 129, may be inserted into the activation slot 127, as described above.

Figure 7:
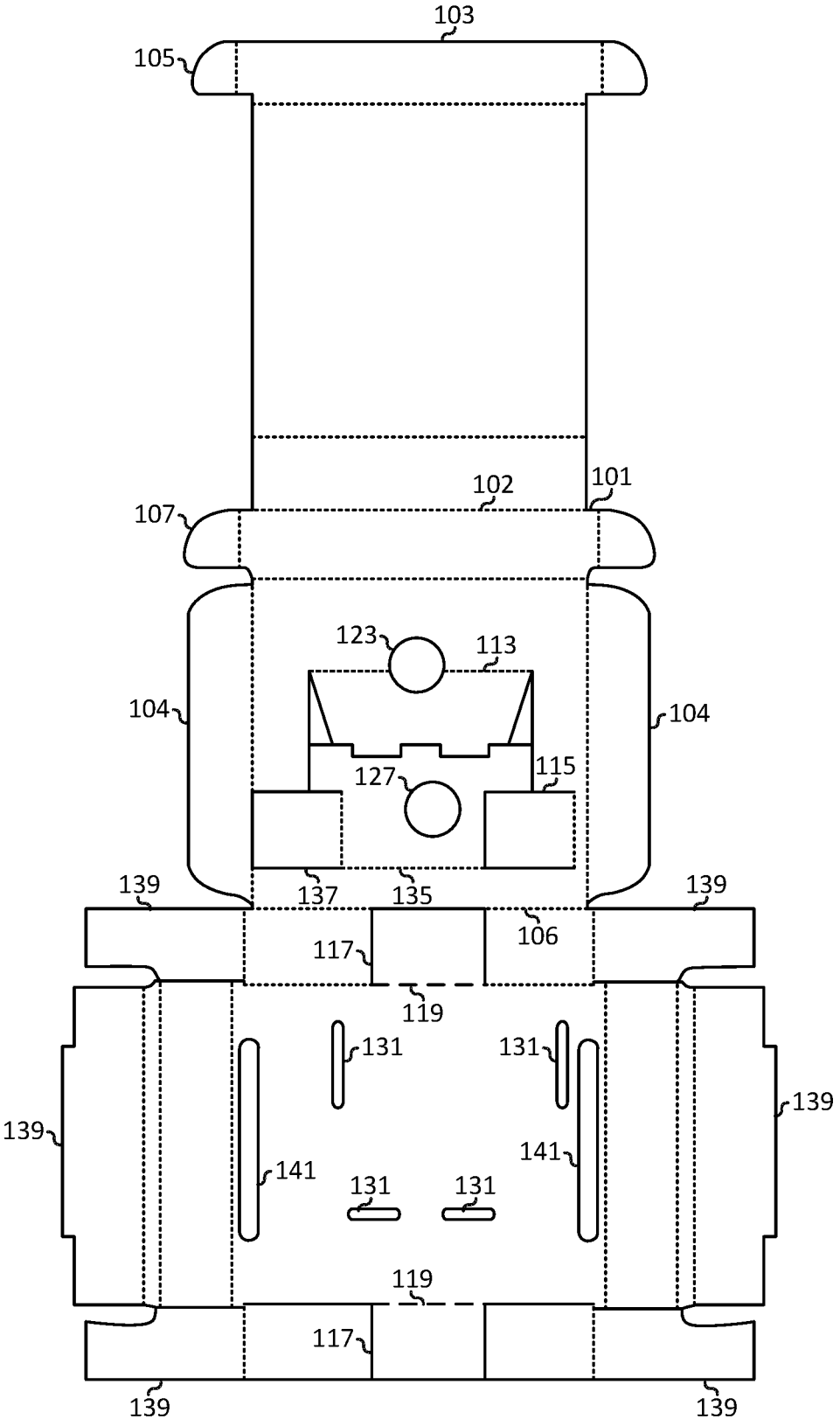
FIG. 7 is a diagram illustrating one embodiment of pliable material that is cut for folding into a tracking device enclosure.

FIG. 7 is a diagram illustrating one embodiment of pliable material that is cut for folding into an enclosure 100. As used herein, pliable material may refer to a material that is foldable such as cardboard, plastic, polystyrene foam, metal, and the like. In some embodiments, a sheet of pliable material may be cut in a single cut. When the sheet of pliable material is cut, the sheet may be folded to form the enclosure 100 as described above. In certain embodiments, when the pliable material is cut, portions of the pliable material may also be pressed to create bendable joints. As illustrated in FIG. 7, the solid lines represent locations where the pliable material is cut, the dotted lines represent bendable joints, dashed lines represent perforated sections of the pliable material.

In certain embodiments, the sheet of pliable material may include enclosure wall structure 139. The different components of the enclosure wall structure 139 may be folded and inserted into the wall structure holes 141. When the wall structure 139 is inserted into the wall structure holes 141, the enclosure 100 may be ready for insertion of a first motion tracking device 109 or other motion tracking device.

In certain embodiments, the first flap 101, the second flap 103, flaps 104, first edge 106, second edge 102, and the tabs 105 and 107 may be described above in FIGS. 1-7. Also, the securing flaps 113 and 115, flap 135, and tab 137, and holes 131 are described above in FIG. 6. Further, the attaching tabs 117 and the perforations 119 are described above in FIG. 3. Additionally, the access locations 123 and activation slot 127 are respectively described above in FIGS. 3 and 4. As described in relation to FIG. 5, the tabs 107 of the first flap 101 may be shaped in such a way that the tabs 107 are securely located within the walls of the enclosure 100 when the second flap 103 is folded over the first flap 101 and the tabs 105 of the second flap 103 are inserted into an opposite side of the enclosure 100. For example, the ends of the tabs 107 may bend and engage with portions of the wall structure 139 to become securely located within the walls of the enclosure 100. Alternatively, the second flap 103 may fold over the first flap 101 in such a way to secure the first flap 101 to the enclosure 100.

Figure 8:
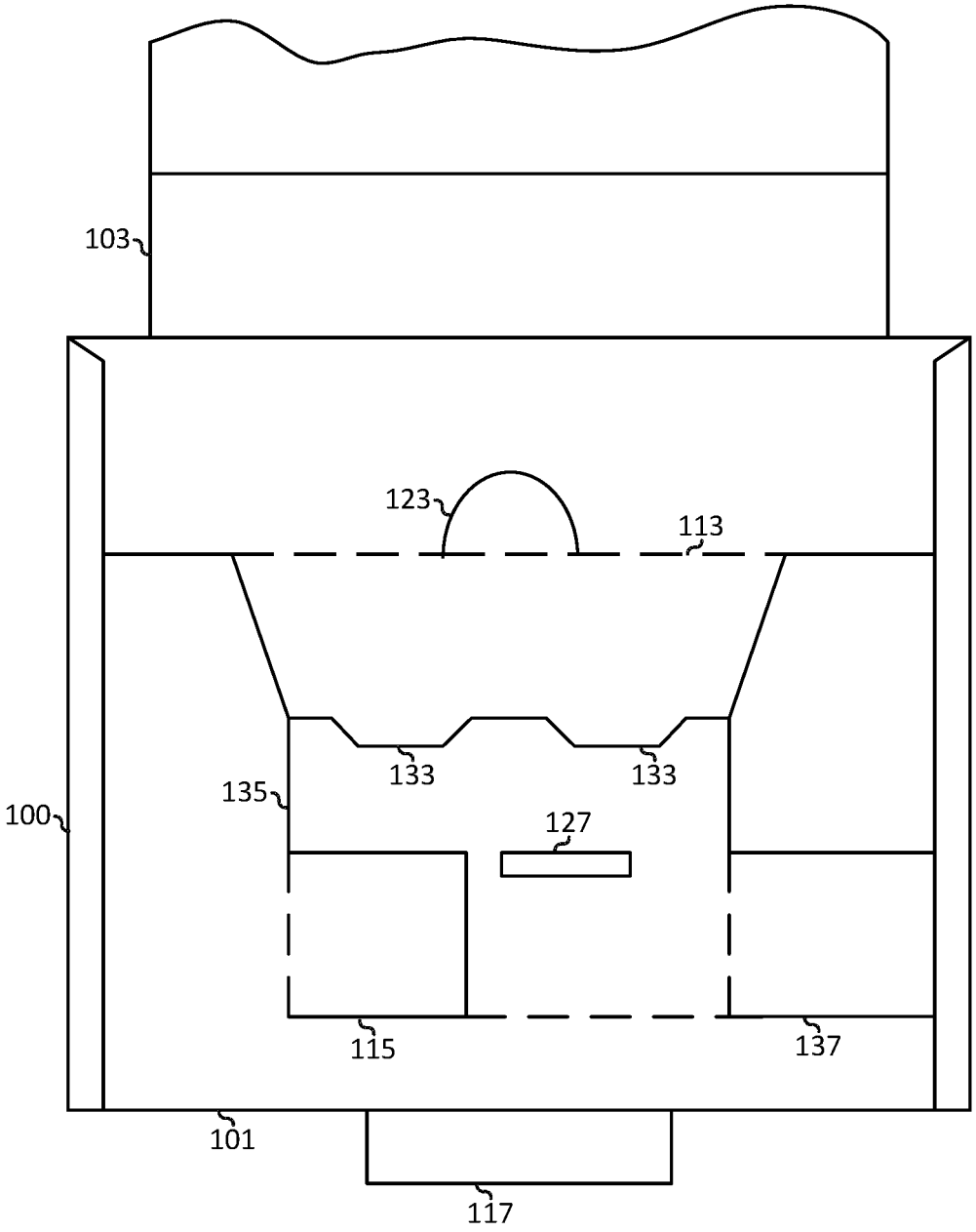
FIG. 8 is a diagram illustrating one embodiment of a secured first flap for the tracking device enclosure.

FIG. 8 is a diagram illustrating one embodiment of a secured first flap 101 for the enclosure 100. As shown, the first flap 101 may have features formed therein for securing a second motion tracking device 111 within the enclosure 100. As described above, the first flap 101 may include securing flaps 113 and 115 which fold down into the enclosure 100 and into holes 131 on the bottom of the enclosure 100. For example, the securing flap 113 includes one or more tabs 133 that extend from the securing flap 113 for engaging the holes 131 on the bottom of the enclosure 100. Additionally, the attaching tabs 117 described above and the second flap 103 may extend from the body of the enclosure 100. As illustrated, only a portion of the second flap 103 is shown.

When the securing flaps 113 and 115 are in place, an opening forms in the first flap 101, where a second motion tracking device 111 may be inserted through the opening. To aid the insertion of the second motion tracking device 111 through the formed opening, the first flap 101 may include a flap 135 that may be lifted up to provide more space for inserting the second motion tracking device 111 into the enclosure 100. Further to aid in lifting the flap 135, the flap 135 may include an additional tab 137. Additionally, when the second motion tracking device 111 is inserted into the enclosure 100, the tab 137 may also be folded into the enclosure 100 to aid in securing the second motion tracking device 111 within the enclosure 100. Additionally, an activation tab may be inserted through the activation slot 127 as the second motion tracking device 111 is placed in the enclosure 100.

In alternative embodiments, securing flaps 113 and 115, may be located in different locations on the first flap 101 of the enclosure 100. Further, securing flaps 113 and 115 may be located on the bottom of the enclosure 100 and fold up into the enclosure 100 towards the first flap 101, where tabs on the ends of the securing flaps 113 and 115 engage with holes in the first flap 101 to secure the securing flaps 113 and 115 in place. Additional securing flaps may also extend from one or more of the sidewalls of the enclosure 100 for securing the location of the motion tracking device with relation to the enclosure 100. As such, the securing flaps 113 and 115 may be part of a set of multiple securing flaps that may be placed at locations within the enclosure 100 to accommodate motion tracking devices of varying sizes. For example, a motion tracking device may be of a size that fits within the enclosure 100. The motion tracking device may be smaller or larger than the second motion tracking device 111.

In additional embodiments, the motion tracking device may have a thickness that is less than the thickness of the interior of the enclosure 100 such that an additional securing flap may extend into the enclosure 100 to secure the motion tracking device between the bottom of the enclosure 100 and the additional securing flap. The additional securing flap may also secure the motion tracking device between the first flap 101 and the additional securing flap.

In further embodiments, the activation slot 127 may be located at various locations within the enclosure 100 to accommodate activation tabs for motion tracking devices of various sizes and configurations. For example, the activation slot 127 may be located on a side wall of the enclosure 100. Alternatively, an activation slot 127 may be located on the bottom of the enclosure 100. Additionally, the enclosure 100 may have one or more activation slots in addition to the activation slot 127. For example, an additional activation slot may be placed opposite to the activation slot 127 on the bottom of the enclosure 100 to accommodate a motion tracking device placed upside down in the enclosure 100 such that an activation tab for the motion tracking device is accessible through the bottom of the enclosure 100. Also, additional activation slots may be located on the first flap 101 or one or more of the sidewalls of the enclosure 100.

Figure 9:
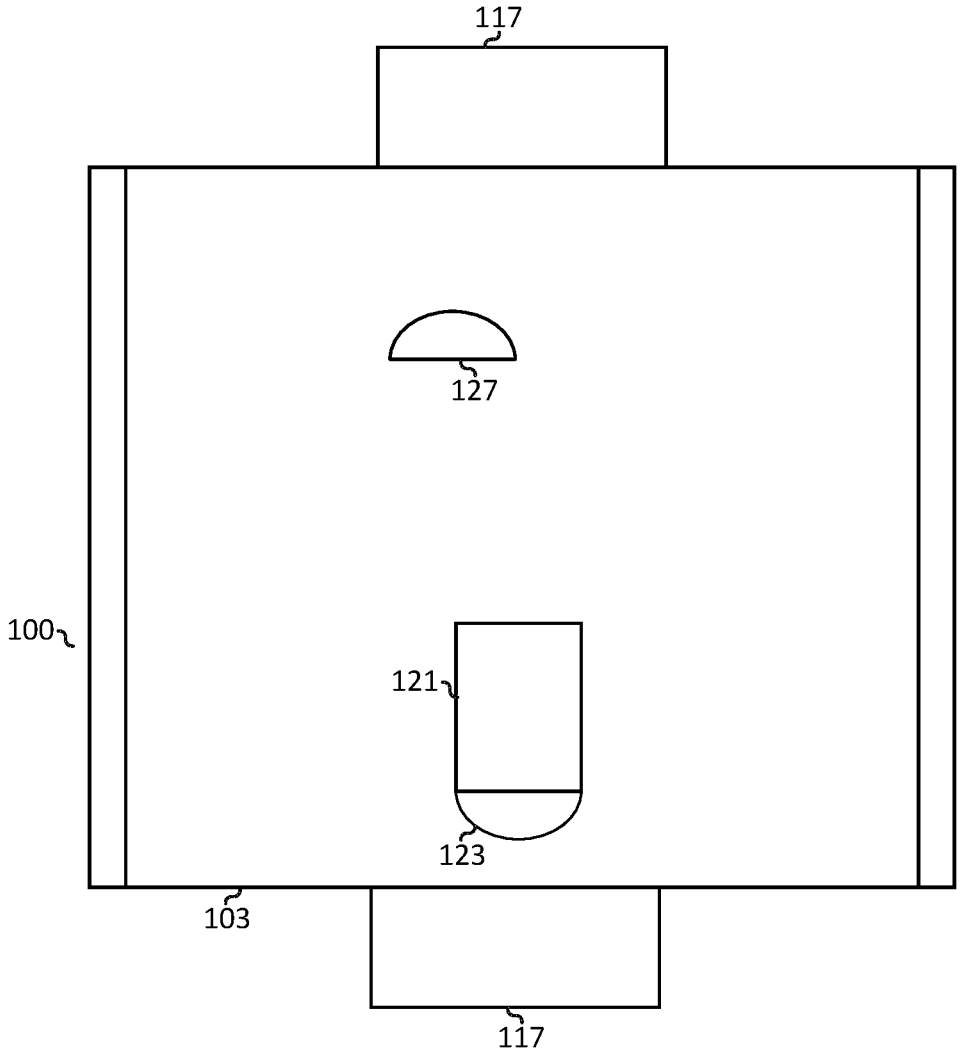
FIG. 9 is a diagram illustrating one embodiment of secured second flap for the tracking device enclosure.

FIG. 9 is a diagram illustrating one embodiment of an enclosure 100 having a secured second flap 103. As illustrated, the second flap 103 may include both an access flap 121 located at an access location 123 and an activation slot 127. The access flap 121 and access location 123 may be substantially similar to the access flap 121 described above with respect to FIG. 3. Additionally, the activation slot 127 may be substantially similar to the activation slot 127 described above with respect to FIG. 4. As shown, by including both the access flap 121 and the activation slot 127, the second flap 103 may be configurable to provide access to activation features of multiple types of motion tracking devices. For example, if a first motion tracking device 109 is within the enclosure, the activation feature of the first motion tracking device 109 may be accessed through the access flap 121. Alternatively, if a second motion tracking device 111 is within the enclosure 100, the activation feature of the second motion tracking device 111 may be accessed through the activation slot 127. When one of the motion tracking devices is within the enclosure 100, the attaching tabs 117 may be securely attached to a shipping container. Whereupon, a user may activate the motion tracking device within the enclosure 100 through one of the activation slot 127 and the access flap 121.

In further embodiments, the access flap 121, access location 123, and activation slot 127 may be located at various locations on the enclosure 100 to accommodate activation tabs for motion tracking devices of various sizes and configurations. For example, as described above with respect to FIG. 8, the activation slot 127 may be located at various locations on the enclosure 100. Similarly, the access flap 121 and the access location 123 may be located at various locations on the enclosure 100. For example, the access flap 121 and the access location 123 may be located on a side wall of the enclosure 100 or the bottom of the enclosure 100.

In additional embodiments, the enclosure 100 may have one or more additional activation features (that include additional activation slots, access flaps, and access locations) in addition to the activation slot 127, the access flap 121, and the access location 123. For example, additional activation features may be placed opposite to the access flap 121, the access location 123, and the activation slot 127 on the bottom of the enclosure 100 to accommodate a motion tracking device placed upside down in the enclosure 100 such that a motion tracking device may be activated through the bottom of the enclosure 100. Also, additional activation features may be located on the first flap 101 or one or more of the sidewalls of the enclosure 100.

Figure 10:
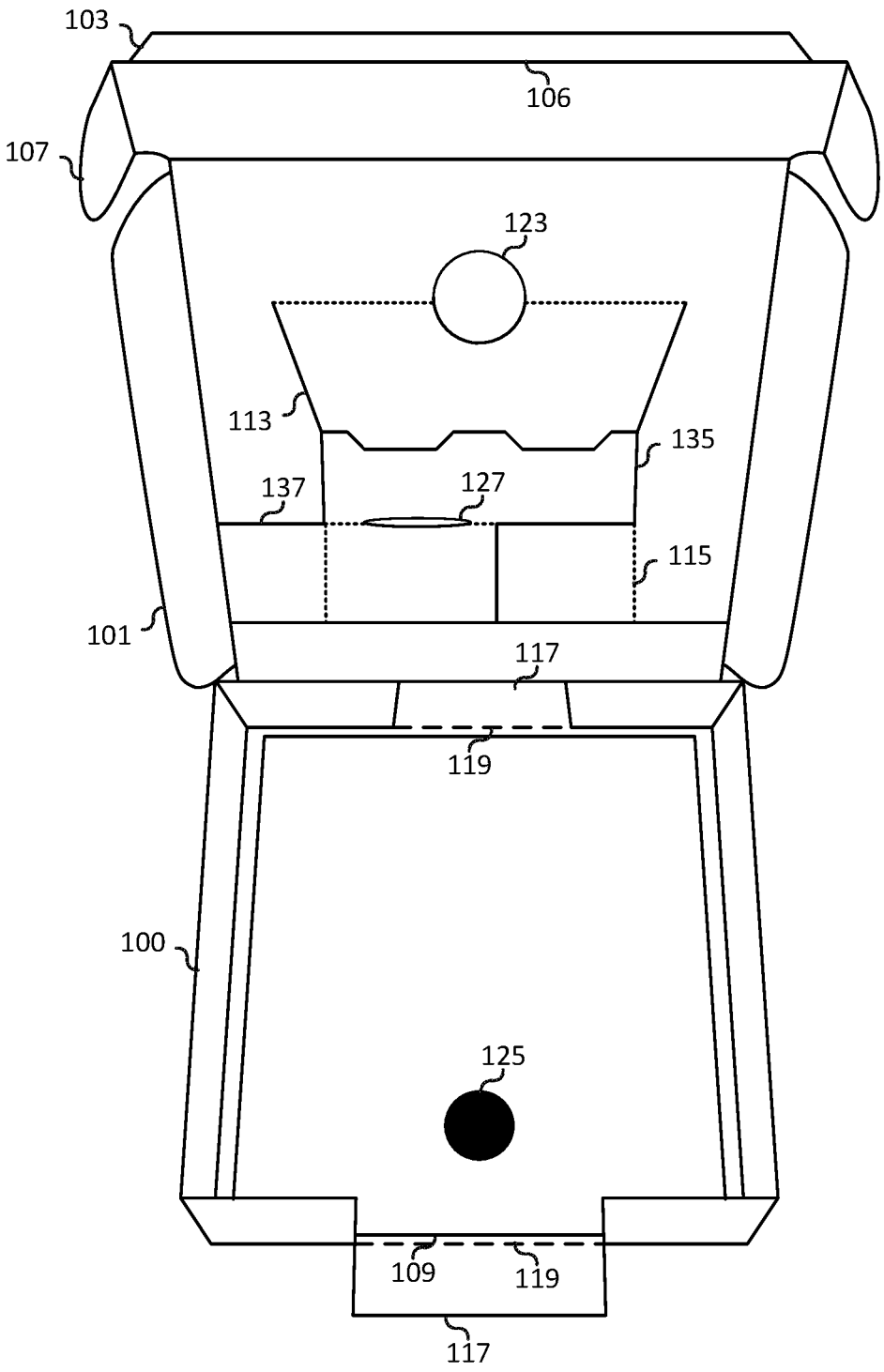
FIG. 10 is a diagram illustrating a first motion tracking device located within an open tracking device enclosure.

FIG. 10 is a diagram illustrating a first motion tracking device 109 located within an open enclosure 100. As illustrated, the interior of the enclosure 100 is substantially similar to the size of the first motion tracking device 109 such that when the first flap 101 encloses the first motion tracking device 109 within the enclosure 100, the first motion tracking device 109 is securely located with respect to the enclosure 100. Accordingly, when the second flap 103 (As illustrated, the second flap 103 is folded back along the second edge 102 behind the first flap 101) of the enclosure 100 is closed and the attaching tabs 117 are fixedly attached to a shipping container, the motion experienced by the shipping container may be the motion experienced and tracked by the first motion tracking device 109. When the enclosure 100 arrives at the destination of the shipping container, the enclosure 100 may be ripped from the attaching tabs 117 at the perforations 119 such that the enclosure 100 and the first motion tracking device 109 may be returned to the sender or other location for analysis of the movement experienced by the first motion tracking device 109 during shipment.

In further embodiments, the first motion tracking device 109 may include an activation feature 125 where the first motion tracking device 109 will not track motion until activated via the activation feature 125 as described above with respect to FIG. 3. As shown, the first flap 101 may include an access location 123 that substantially corresponds with the location of the activation feature 125 when the first flap 101 encloses the first motion tracking device 109 within the enclosure 100. For example, when the activation feature 125 is a button, the access location 123 may be a hole in the first flap 101 that is approximately the same size as the activation feature 125 of the first motion tracking device 109. Other features illustrated in FIG. 10, such as the securing flaps 113 and 115, the activation slot 127, the tab 137 and the device location flap 135 may facilitate the use of a motion tracking device other than the first motion tracking device 109 as described above.

Figure 11:
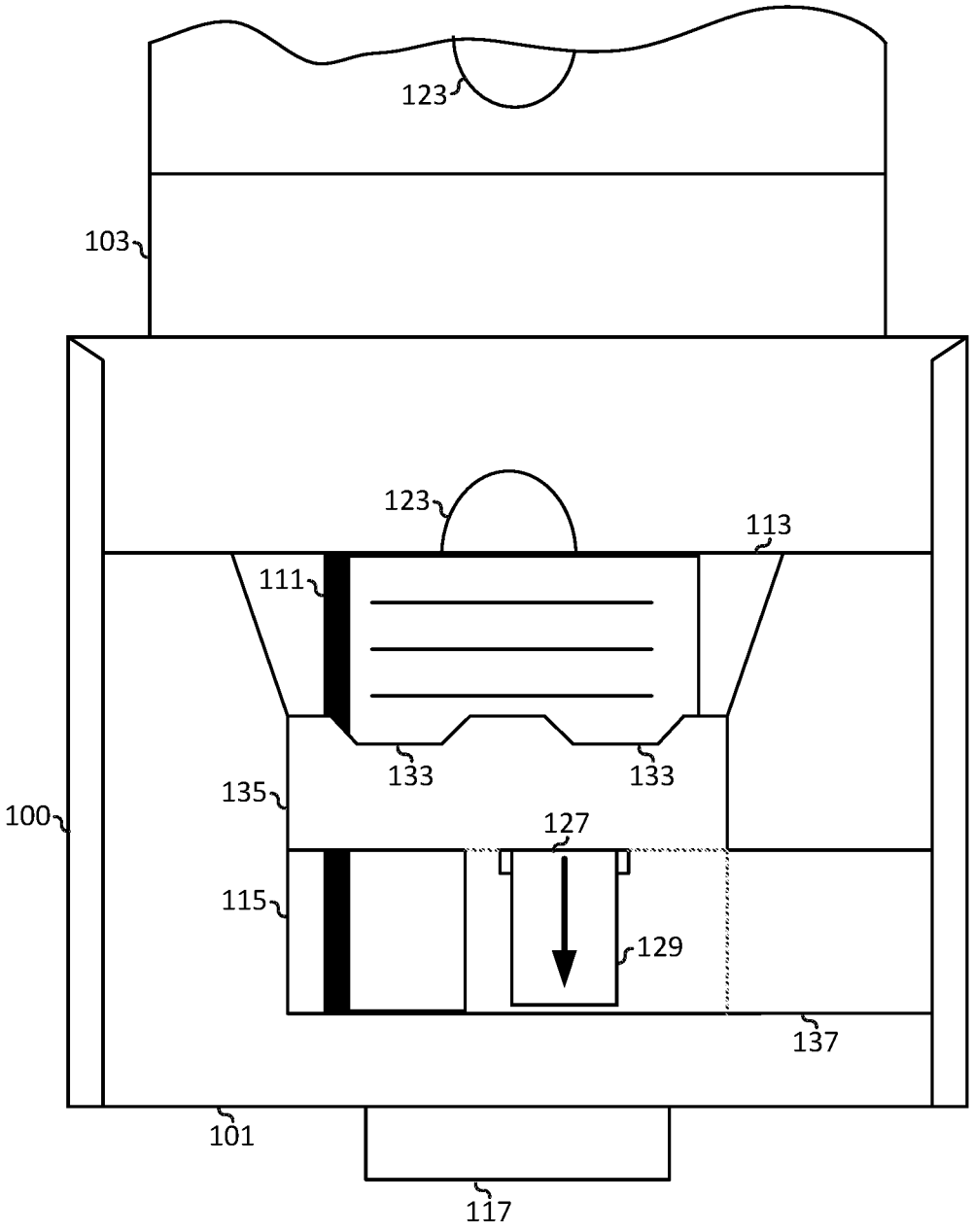
FIG. 11 is a diagram illustrating a second motion tracking device located within a tracking device enclosure.

FIG. 11 is a diagram illustrating a second motion tracking device 111 located within an enclosure 100. As illustrated, a second motion tracking device 111 may be located within the enclosure 100. In certain embodiments, to place the second motion tracking device 111 within the enclosure 100, the first flap 101 may be secured to enclose a volume of the enclosure 100. When the first flap 101 is secured, the securing flap 113 may be folded into the volume of the enclosure 100. Likewise, the securing flap 115 may be folded into the volume of the enclosure 100.

In certain embodiments, to insert the first motion tracking device 109 into the enclosure 100 a flap 135 may be lifted away from the enclosure 100 to enlarge the opening for insertion of the second motion tracking device 111. To facilitate the lifting of the flap 135, a tab 137 may be attached to the flap 135. The tab 137 may bend away from the enclosure 100 along a common edge shared with the flap 135. When the tab 137 is bent away from the enclosure 100, a user may pull on the tab 137 to bend the flap 135 away from the enclosure 100. Alternatively, to pull on the tab 137, the side wall of the enclosure 100 may have a flap or hole by which a user may bend the flap 135 away from the enclosure 100. Also, the enclosure 100 may have a hole in the bottom of the enclosure 100 by which a user may push the flap 135 to bend the flap 135 away from the enclosure 100.

As illustrated, the flap 135 may include an activation slot 127 formed therein. When the second motion tracking device 111 is inserted into the enclosure 100, an activation tab 129 attached to the second motion tracking device 111 may be threaded through the activation slot 127. When the activation tab 129 is threaded through the activation slot 127, the flap 135 may be bent toward the second motion tracking device 111 such that the device location flap 135 rests against a surface of the second motion tracking device 111. When the flap 135 rests against a surface of the second motion tracking device 111, the tab 137 may be bent into the enclosure 100 and secured within the enclosure 100 such that the tab 137 functions similarly to the securing flap 115. When the tab 137 is secured within the enclosure 100, the second flap 103 may be secured over the enclosure 100 and the activation tab 129 may be threaded through the corresponding activation slot 127 in the second flap 103.

In certain embodiments, when the second flap 103 is secured over the enclosure 100, the second motion tracking device 111 becomes securely located with respect to the enclosure 100. In particular, the second motion tracking device 111 may be secured within the enclosure 100 between various flaps that extend into the volume of the enclosure 100. For example, the second motion tracking device 111 may be securely located in a first dimension within the enclosure 100 by abutting against a surface of the securing flap 113 and an interior side surface of the enclosure 100. Further, the second motion tracking device 111 may be securely located in a second dimension within the enclosure 100 by abutting against a surface of the securing flap 115 and a surface of the tab 137. Additionally, the second motion tracking device 111 may be securely located in a third dimension within the enclosure 100 by abutting against the flap 135, which is secured in place by the second flap 103, and a bottom interior surface of the enclosure 100.

Accordingly, when the second motion tracking device 111 is securely located with reference to the enclosure 100 and the attaching tabs 117 are fixedly secured to a shipping container, the second motion tracking device 111 may be activated by pulling the activation tab 129 away from the enclosure 100 through the activation slot 127. Thereafter, when the second motion tracking device 111 records movement, the recorded movement may reliably reflect the movements experienced by the shipping container.

The descriptions of the various embodiments of the present invention have been presented for purposes of illustration but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. An apparatus comprising:

an enclosure that holds a motion tracking device to a shipping container, the enclosure comprising:

one or more first flaps that secure a first motion tracking device within the enclosure such that the first motion tracking device does not move in relation to the enclosure, wherein the one or more first flaps secure the first motion tracking device based on a shape of the first motion tracking device; and one or more second flaps that secure a second motion tracking device within the enclosure such that the second motion tracking device does not move in relation to the enclosure, wherein the one or more second flaps secure the second motion tracking device based on a shape of the second motion tracking device wherein the one or more first flaps comprise a first flap that folds over the first motion tracking device and one or more tabs that fold into openings in the enclosure; and wherein the one or more second flaps comprise a second flap that folds back over the first flap, wherein when the second flap is secured over the first flap, the second flap encloses the second motion tracking device within the enclosure based on the shape of the motion tracking device.

2. The apparatus of claim 1, further comprising one or more attaching tabs extending from a bottom of the enclosure, wherein the one or more attaching tabs extend away from the enclosure and, wherein the one or more attaching tabs are attachable to a surface of the shipping container to secure the enclosure to the shipping container.

3. The apparatus of claim 2, wherein the one or more attaching tabs are perforated to remain connected to the shipping container when the enclosure is pulled away from the shipping container.

4. The apparatus of claim 1, wherein the enclosure further comprises one or more access flaps that provide access to activation features of the first motion tracking device, the second motion tracking device or both, wherein the activation features of the first motion tracking device are configured to allow a user to activate the first motion tracking device to begin tracking movement of the shipping container and wherein the activation features of the second motion tracking device are configured to allow a user to activate the second motion tracking device to begin tracking movement of the shipping container.

5. The apparatus of claim 1, wherein the enclosure further comprises one or more activation slots to remove an activation tab of the second motion tracking device.

6. The apparatus of claim 1, wherein a portion of the one or more second flaps extends into a space for holding the first motion tracking device, wherein the second motion tracking device is secured within the space.

7. The apparatus of claim 1, wherein the enclosure is made from a single sheet of pliable material.

8. The apparatus of claim 1, wherein the enclosure comprises one or more holes that secure one or more tabs in place, wherein the one or more tabs are located at ends of a portion of the one or more first flaps and a portion of the one or more second flaps.

9. The apparatus of claim 1, wherein the enclosure is secured in a closed state with one or more tamper resistant seals.

10. The apparatus of claim 1, wherein the enclosure comprises one or more openings for viewing or adding markings on the motion tracking devices.

11. The apparatus of claim 1, wherein the second motion tracking device is smaller than the first motion tracking device.

12. The apparatus of claim 1, wherein the enclosure comprises one or more openings to expose one or more of the first motion tracking device and the second motion tracking device to an environment of the enclosure, wherein each motion tracking device senses characteristics of an environment of the container.

13. An apparatus comprising:

an enclosure that holds a motion tracking device to a shipping container, the enclosure comprising a plurality of flaps that secures the motion tracking device within the enclosure such that the motion tracking device does not move in relation to the enclosure, wherein the plurality of flaps secures the motion tracking device based on a shape of the motion tracking device, the plurality of flaps comprising:

a first flap with tabs, the first flap folds over the motion tracking device and the tabs of the first flap fold into openings in the enclosure; and a second flap that folds back over the first flap, wherein when the second flap is secured over the first flap, the second flap encloses the motion tracking device within the enclosure based on the shape of the motion tracking device; and one or more attaching tabs extending from a bottom of the enclosure, wherein the one or more attaching tabs extend away from the enclosure and, wherein the one or more attaching tabs are attachable to a surface of the shipping container to secure the enclosure to the shipping container.

14. The apparatus of claim 13, wherein the motion tracking device comprises a first motion tracking device and wherein the plurality of flaps further comprises:

one or more third flaps that secure a second motion tracking device within the enclosure such that the second motion tracking device does not move in relation to the enclosure, wherein the one or more third flaps secure the first motion tracking device.

15. The apparatus of claim 13, wherein the one or more attaching tabs are perforated to remain connected to the shipping container when the enclosure is pulled away from the shipping container.

16. The apparatus of claim 13, wherein the enclosure further comprises one or more access flaps that provide access to activation features of the motion tracking device, wherein the activation features are configured to allow a user to activate the motion tracking device to start tracking motion of the shipping container.

17. The apparatus of claim 13, wherein the enclosure is made from a single sheet of pliable material.

18. The apparatus of claim 13, wherein the enclosure comprises one or more openings for viewing or adding markings on the motion tracking device.

19. An apparatus comprising:

an enclosure that holds a motion tracking device, the enclosure comprising:

a plurality of first flaps that secures a first motion tracking device within the enclosure such that the first motion tracking device does not move in relation to the enclosure, wherein the plurality of first flaps secures the first motion tracking device based on a shape of the first motion tracking device, wherein the plurality of first flaps comprises a third flap with tabs, wherein the third flap folds over the first motion tracking device and the tabs of the third flap fold into openings in the enclosure; and a plurality of second flaps that secures a second motion tracking device within the enclosure such that the second motion tracking device does not move in relation to the enclosure, wherein the plurality of second flaps secures the second motion tracking device based on a shape of the second motion tracking device, wherein the plurality of second flaps comprises a fourth flap, wherein the fourth flap folds back over the third flap, wherein the fourth flap encloses the second motion tracking device; and one or more attaching tabs extending from a bottom of the enclosure, wherein the one or more attaching tabs extend away from the enclosure and, wherein the one or more attaching tabs are attachable to a surface of a shipping container to secure the enclosure to the shipping container.

* * * * *